US007071806B2

(12) United States Patent
Masu et al.

(10) Patent No.: US 7,071,806 B2
(45) Date of Patent: Jul. 4, 2006

(54) VARIABLE INDUCTOR AND METHOD FOR ADJUSTING INDUCTANCE OF SAME

(75) Inventors: Kazuya Masu, 1254-2-406, Kamihirama, Nakahara-ku, Kawasaki-shi, Kanagawa 211-0013 (JP); Akira Shimokohbe, 2-24-7, Tsukushino, Machida-shi, Tokyo 194-0001 (JP); Seiichi Hata, 2-32-3-20-303, Narusedai, Machida-shi, Tokyo 194-0043 (JP); Yoshio Satoh, Kawasaki (JP); Fumio Yamagishi, Kawasaki (JP)

(73) Assignees: Fujitsu Limited, Kawasaki (JP); Kazuya Masu, Kawasaki (JP); Akira Shimokohbe, Tokyo (JP); Seiichi Hata, Tokyo (JP)

( * ) Notice: Subject to any disclaimer, the term of this patent is extended or adjusted under 35 U.S.C. 154(b) by 0 days.

(21) Appl. No.: 10/650,823

(22) Filed: Aug. 29, 2003

(65) Prior Publication Data

US 2004/0090298 A1 May 13, 2004

(30) Foreign Application Priority Data

Sep. 13, 2002 (JP) ..... 2002-268463

(51) Int. Cl.
*H01F 5/00* (2006.01)

(52) U.S. Cl. ..... 336/200; 336/116; 336/223; 29/602.1

(58) Field of Classification Search ..... 336/200, 336/223, 232, 180; 29/602.1, 606
See application file for complete search history.

(56) References Cited

U.S. PATENT DOCUMENTS 4,035,695 A * 7/1977 Knutson et al. ..... 361/782
5,239,289 A * 8/1993 Ferraiolo et al. ..... 336/180
5,426,404 A * 6/1995 Kommrusch et al. ..... 333/246
6,005,467 A * 12/1999 Abramov ..... 336/200

(Continued)

FOREIGN PATENT DOCUMENTS

EP 0 800 185 10/1997
EP 1 069 576 1/2001
EP 0 654 802 6/2002

(Continued)

OTHER PUBLICATIONS

Seiichi Hata, et al., Precision Engineering Journal, vol. 66. No. 1, 2000 pp. 96-101.

(Continued)

*Primary Examiner*—Anh Mai
(74) *Attorney, Agent, or Firm*—Armstrong, Kratz, Quintos, Hanson & Brooks, LLP.

(57) ABSTRACT

A variable inductor includes an insulating substrate (1), a thermally softenable spiral coil (2) provided on the insulating substrate (1), and a pair of input/output terminals (3, 4) each connected electrically to a respective end of the coil (2). Preferably, the coil (2) is made from a non-crystalline thin film metallic glass which softens in a supercooled liquid phase.

17 Claims, 12 Drawing Sheets

U.S. PATENT DOCUMENTS

| | | | | |
|---|---|---|---|---|
| 6,072,992 | A * | 6/2000 | Mishima et al. | 455/76 |
| 6,114,938 | A * | 9/2000 | Iida et al. | 336/200 |
| 6,184,755 | B1 | 2/2001 | Barber et al. | 331/181 |
| 6,225,677 | B1 * | 5/2001 | Kobayashi | 257/531 |
| 6,369,683 | B1 | 4/2002 | Iida et al. | 336/200 |
| 6,369,684 | B1 * | 4/2002 | Iida et al. | 336/200 |
| 6,759,261 | B1 * | 7/2004 | Shimokohbe et al. | 438/48 |
| 2002/0072203 | A1 | 6/2002 | Shimokhbe et al. | 438/482 |

FOREIGN PATENT DOCUMENTS

| | | |
|---|---|---|
| JP | 35-21062 | 8/1960 |
| JP | 5-159938 | 6/1993 |
| JP | 2004-111452 A * | 4/2004 |

OTHER PUBLICATIONS

Seiichi Hata, et al., Precision Engineering Journal, vol. 66 No. 2, 2000 pp. 287-291.

Seiichi Hata, et al., Precision Engineering Journal, vol. 66. No. 10, 2000 pp. 1708-1713.

Yondong Liu, et al., Jpn. J. Appl. Phys. vol. 40 (2001) pp. 5382-5388 Part 1, No. 9A, Sep. 2001, pp. 5382-5388.

* cited by examiner

VARIABLE INDUCTOR AND METHOD FOR ADJUSTING INDUCTANCE OF SAME

BACKGROUND OF THE INVENTION

1. Field of the Invention

The present invention relates to a variable inductor, and more particularly, to a variable inductor element used in a mobile communications device, or the like. Moreover, the present invention also relates to a method for adjusting the inductance of a variable inductor.

2. Description of Related Art

With advances in compactification and higher frequency operation of electronic devices, there have been accompanying demands for compactification and higher frequency operation in passive elements, such as inductors, and the like. Inductors are problematic in that (1) they are more difficult to fabricate in a coil shape compared to other passive elements, and (2) increased operating frequencies are difficult to achieve due to the parasitic capacitance between the inductor and the substrate. Moreover, a structure for an inductor which is capable of altering the inductance is known, wherein the inductance is adjusted by cutting (trimming) a trimming wire provided in the coil, by means of a laser, or the like, as disclosed in JP-A 2000-223318 (FIGS. 1 to 3).

However, in the method disclosed in the above document, since the inductance is adjusted by cutting a trimming wire by means of a laser, or the like, it is not possible to restore the trimming wire once it has been cut, and hence a problem arises in that the inductance cannot be adjusted in a reversible manner. Moreover, adjustment of the inductance by cutting a trimming wire only permits the inductance to be changed in a step-like fashion, and does not allow continuous adjustment of the inductance within a prescribed range.

SUMMARY OF THE INVENTION

It is, therefore, a principal object of the present invention is to provide a variable inductor wherein the inductance can be altered in a reversible and continuous fashion.

Another object of the present invention is to provide an method for adjusting inductance in a variable inductor of this kind.

According to a first aspect of the present invention, a variable inductor is provided which comprises a substrate, a thermally softenable spiral coil provided on the substrate, and a pair of input/output terminals each electrically connected to a respective end of the coil.

With the aforementioned structure, the thermally softenable coil is deformed elastically by applying an external force, and in this state, it is heated to the temperature at which the material softens, thereby alleviating the stress generated by the elastic deformation. Then, upon cooling, the coil maintains its shape even when the external force is removed. Consequently, by changing the height of the coil, the state of the magnetic flux and the coil density are caused to change, and hence the inductance can be altered. Moreover, since the coil can be softened by heating, then it is possible to readjust the inductance even after the inductance has already been altered, by performing elastic deformation of the coil again and then heating for softening the coil.

The coil may be formed of any material selected from a group consisting of an electrically conductive material which is softenable by heating, a non-conductive material, which is softenable by heating, formed with a coating of electrically conductive material, and an electrically conductive material, which is softenable by heating, formed with a coating of another electrically conductive material (preferably, an electrically conductive material which is softenable by heating is coated with another electrically conductive material having a lower electrical resistance).

In particular, the coil is preferably made from a non-crystalline thin film metallic glass which softens in a supercooled liquid phase. A "metallic glass" is a non-crystalline solid having excellent mechanical properties at room temperature, which transforms as its temperature rises, in sequence, from a supercooled liquid state which is a semi-solid state (liquid of viscosity 1013–108 Pa·s) (transformation at glass transition point Tg) to a crystalline solid state (transformation at initial crystallization temperature Tx), and to a liquid state (transformation at melting point Tm). Of these state transitions, that between the non-crystalline solid state and the supercooled liquid state is reversible, and the temperature range in which the supercooled liquid state is maintained (the supercooled liquid phase:between the glass transition point Tg and the initial crystallization temperature Tx) is relatively broad, and hence the material can readily be heated to the supercooled liquid state. Consequently, by heating a coil formed from non-crystalline thin film metallic glass to a supercooled liquid phase, whilst it is in an elastically deformed state, then any stress generated internally by the elastic deformation can be eliminated completed by the annealing effect, and by then cooling the coil, it can be returned to its original non-crystalline solid state. Moreover, since this phase transition is reversible, the height of the coil can be changed any number of times by repeating the operations of elastic deformation and heating and softening, and hence readjustment of the inductance can be performed readily. Pd-based thin film metallic glass (Pd76Cu7Si17) or zr-based thin film metallic glass (Zr75Cu19A16) are examples of non-crystalline thin film metallic glasses.

As a method for manufacturing the variable inductor, firstly, a planar coil is fabricated using a thermally softenable thin film material such as a thin film metallic glass. A prescribed portion of this planar coil is raised upwards by an external force, thereby causing the coil to deform elastically into a circular conical coil or square conical coil, and in this state, the coil is heated to a temperature at which the thin film material forming same softens, thereby alleviating the elastic stress inside the coil. By subsequently cooling the coil, the desired variable inductor is obtained. In adjusting the height of the coil, a height adjusting jig or a height adjusting member is used, and in heating the coil, commonly known heating means, such as infrared irradiation or laser irradiation.

According to a desired embodiment of the present invention, a drive electrode is also provided on the substrate underneath the coil, via an insulating layer, in such a manner that the coil can be attracted electrostatically, thereby changing the height of the coil, by applying a voltage between the drive electrode and the coil. By means of this structure, it is possible to change the inductance of the coil in a dynamic fashion, and moreover, by removing the applied voltage, the coil reverts to its original form, due to its elastic properties, and the inductance reverts to its original figure.

Preferably, a plurality of the drive electrodes are provided opposing the coil, and connection terminals are provided for applying voltage individually to each of the drive electrodes. Thereby, it is possible to control the inductance of the coil in a step-like fashion over a relatively broad range, by appropriately selecting a certain plurality of drive electrodes and applying voltage to same.

Preferably, the drive electrode comprises a spiral slit having a width which varies as it extends in the circumferential direction of the coil. Alternatively, it is also possible for the drive electrode itself to have a fine-tipped spiral shape wherein the width varies as it extends in the circumferential direction of said coil. By appropriately selecting the shape and position of the actual drive electrode and slit, it is possible to generate an ideal electrostatic force of attraction in accordance with the position of the coil, and hence the inductance can be adjusted in a continuous fashion.

According to a further embodiment of the present invention, there are also provided: a pressing member abutting against the coil, and an actuator or adjustment mechanism for driving the pressing member heightwise of the coil. By means of this structure, it is possible to change the inductance of the coil dynamically, and moreover, it is possible to return the coil to its original state.

The actuator may support the pressing member from the opposite side to the coil, or it may support the pressing member from the said side as the coil.

According to a further desired embodiment of the present invention, a piezoelectric thin film and a driving electrode are formed over the coil, in addition to which a connection terminal connected to the drive electrode is provided on the insulating substrate. By means of this structure, the coil is directly caused to deform elastically, by deformation of the piezoelectric thin film, thereby adjusting the inductance.

According to a further desired embodiment of the present invention, there is further provided: a connection plate connected to one end of the coil, for contacting a portion of the coil other than the end, thereby reducing the effective number of windings of the coil, when the coil has been deformed elastically in a height reducing direction, and for conversely increasing the effective number of windings of the coil when the coil has been deformed elastically in a height increasing direction. By means of this structure, the effective number of windings of the coil is changed in conjunction with the change in the height of the coil, and hence the rate of change of the inductance can be increased.

Preferably, the connection plate may have a doughnut shape, and a plurality of slits arranged at intervals in the circumferential direction may also be provided therein. These slits has the effect of facilitating the passage of magnetic flux.

A second aspect of the present invention provides a method for adjusting the inductance of a variable inductor comprising an insulating substrate, a thermally softenable spiral coil provided on the insulating substrate, and a pair of input/output terminals each electrically connected to a respective end of the coil, the method comprising at the least the steps of: compressing or extending the coil, thereby changing the height thereof; and heating the coil a softening temperature thereof after the change of the height followed by cooling to set an initial height of the coil. The advantages of this method are similar to those described in relation to the structure of the variable inductor.

Furthermore, the method for adjusting inductance may also comprise the step of: fixing the initial height set for the coil by enclosing the coil in resin. By this means, it is possible to ensure that the inductance does not change unintentionally, after it has been correctly adjusted.

Alternatively, instead of the foregoing, the method for adjusting inductance may also comprise a step of dynamically changing the height of the coil, for which an initial height has been set, by compressing or extending the coil electrostatically or piezoelectrically.

A third aspect of the present invention provides a method for adjusting inductance in a variable inductor comprising: an insulating substrate; a spiral coil provided on the insulating substrate; and a pair of input/output terminals each connected electrically to a respective end of the coil; the method comprising the steps of: compressing or extending the coil, thereby changing the height thereof; heating the coil to a softening temperature thereof after the change of the height followed by cooling to set an initial height of the coil; and fixing the initial height set for the coil by enclosing the coil in resin.

Various features and merits of the present invention will become apparent from the following description of the preferred embodiments with reference to the accompanying drawings.

DETAILED DESCRIPTION OF THE PREFERRED EMBODIMENTS

The preferred embodiments of the present invention are described below in detail with reference to the accompanying drawings.

First Embodiment

Figure 1:
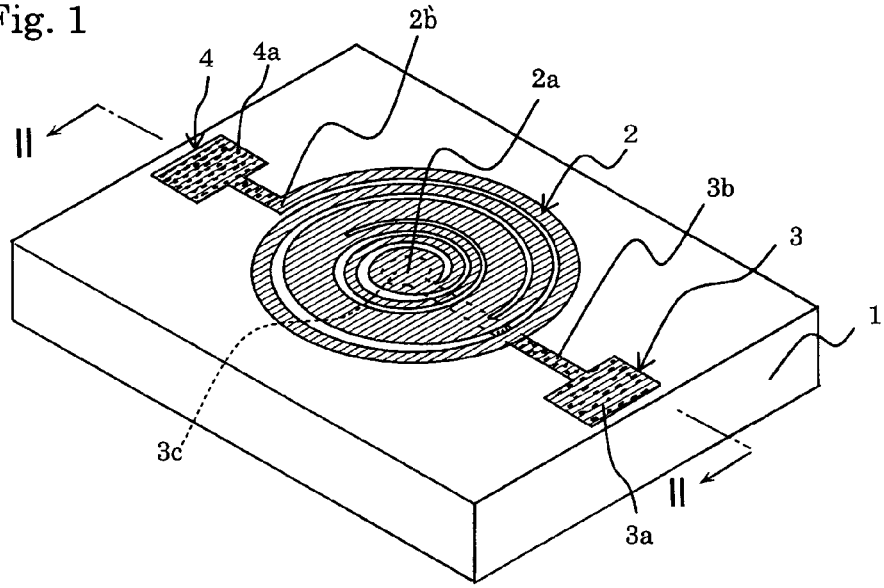
FIG. 1 is a perspective view showing a variable inductor before inductance adjustment, according to a first embodiment of the present invention.
Figure 2:
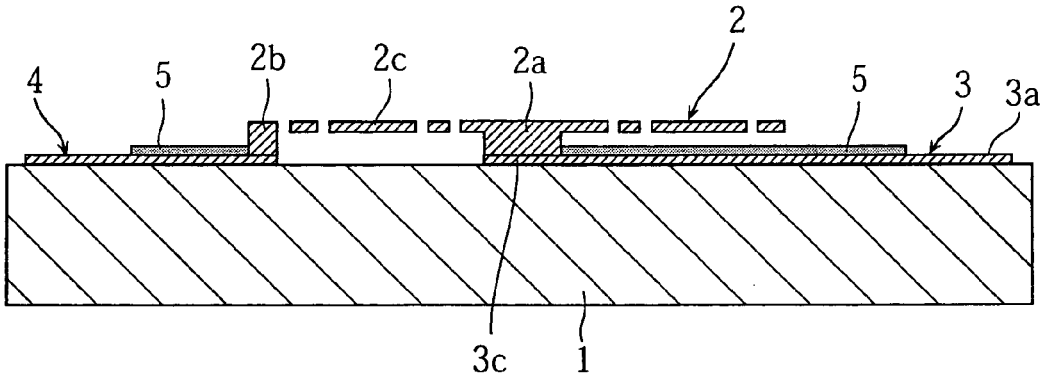
FIG. 2 is a sectional view along line II—II in FIG. 1.
Figure 3:
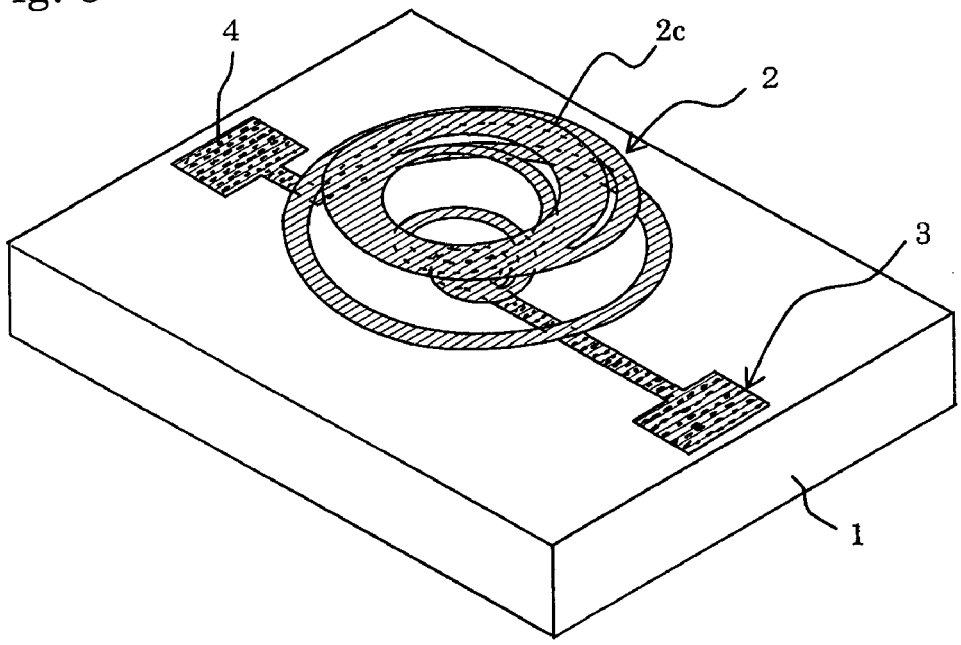
FIG. 3 is a perspective view showing the same variable inductor after inductance adjustment.

FIGS. 1 to 3 show a variable inductor according to a first embodiment of the present invention. Here, FIG. 1 is a perspective view showing the state of a variable inductor before inductance adjustment, and FIG. 2 is a sectional view along line II—II in FIG. 1. Moreover, FIG. 3 is a perspective view showing the state of a variable inductor after inductance adjustment.

As shown in FIG. 1, the variable inductor according to the present embodiment has a structure wherein a spiral coil 2 and a pair of input/output terminals 3, 4 are patterned onto an insulating substrate 1 by means of a manufacturing process described hereinafter. A material having full insulating properties, such as quartz, glass ceramic, alumina, ferrite, or the like, can be used as the insulating substrate 1. Moreover, in addition to materials which are fully insulating, it is also possible to use a semiconductor material, such as silicon layered with a silicon oxide or silicon nitride film on the surface thereof, as the material for forming the substrate 1.

The respective input/output terminals 3, 4 are made from Pt, for example, and are patterned by means of a commonly known photolithography method, for example. One of the terminals 3 (hereinafter, called the "first terminal") comprises an outer terminal 3*a*, a projecting section 3*b* which extends from this outer terminal 3*a* in the direction of the approximate centre of the substrate 1, and an inner terminal 3*c* connected to this projecting section 3*b* in the approximate centre of the substrate 1. The other terminal 4 (hereinafter, called the "second terminal") comprises an outer terminal 4*a* and a projecting section 4*b* which extends from this outer terminal 4*a* in the direction of the outer circumference of the spiral coil 2. In order to reduce the electrical resistance in accordance with requirements, it is also possible to form, additionally, aluminium, metal, copper, or the like, onto the respective terminals 3, 4, by means of a commonly known method, such as plating, sputtering, vapor deposition, or the like.

As revealed by FIG. 2, the spiral coil 2 is directly connected electrically to the first terminal 3 by means of an inner terminal 2*a* thereof. Similarly, an outer terminal 2*b* of the spiral coil 2 is directly connected electrically to the second terminal 4. However, in a position other than that of the aforementioned inner terminal 2*a* and the outer terminal 2*b*, the spiral coil 2 is slightly separated (for example, by approximately 1 μm) from the substrate 1 in such a manner that it can move in a floating fashion. Consequently, it is possible to alter the height of the coil 2, thereby causing the inductance to change, by raising up the intermediate ring-shaped portion 2*c* of the spiral coil 2 formed between the inner terminal 2*a* and the outer terminal 2*b* (the concrete method being described hereinafter.) Moreover, with the exception of the outer terminals 3*a*, 4*a* and the inner terminals 3*b*, 4*b* which require electrical current to pass through them, the respective terminals 3, 4 are covered by an insulating film 5, such as silicon oxide, or the like, (this being omitted in FIG. 1 and FIG. 3, for the sake of convenience). Thereby, even if a portion of the coil 2 drops down under its own weight, it will not be able to make a connection with the projecting section 3*b* of the first terminal 3.

The spiral coil 2 is made from an electrically conductive material which softens when heated, but which is capable of maintaining its form after softening. In the present embodiment, the spiral coil 2 was manufactured by forming a film of Pd based thin film metallic glass (Pd76Cu7Si17, where the suffixes indicate atomic percentages) by sputtering, to a thickness of 5 μm, and then patterning same by means of lithography (details of this method are described hereinafter). The Pd-based thin film metallic glass is non-crystalline and has a supercooled liquid phase, being softened but retaining a semi-solid state, when heated up to the temperature corresponding to the supercooled liquid phase. Therefore, by performing elastic deformation of the spiral coil 2 formed from Pd-based thin film metallic glass, with the object of adjusting the inductance, and then heating the coil, it is possible to relieve the stress generated by the elastic deformation, and at the same time eliminate any faults, such as voids, present inside the coil, whilst retaining the shape after deformation. Furthermore, if the Pd-based thin film metallic glass is cooled once it has been softened, then it will return, reversibly, to its original non-crystalline solid state. Therefore, the inductance of the spiral coil 2 can be readjusted any number of times by repeating the heating and cooling operations. It is also possible for aluminium, metal, copper, or the like, to be coated additionally onto the coil 2, by means of a commonly known technique, such as plating, sputtering, vapor deposition, or the like, in order to reduce the electrical resistance according to requirements.

Instead of Pd-based thin film metallic glass, it is also possible to use Zr-based thin film metallic glass (Zr75Cu19A16). In addition to using non-crystalline thin film metallic glass of this kind as an electrically conductive material which softens when heated, it is also possible to use an electrically conductive polymer material (for example, polyacetylene, polypyrrole, polythiophene, and the like), metal, electrically conductive glass (ITO Indium Tin Oxide), an insulating polymer material deposited with an electrically conductive material, insulating glass deposited with an electrically conductive material, and the like, provided that it has a softening point.

Next, a method for manufacturing a variable inductor having the structure described above and a method for adjusting the inductance thereof are described on the basis of FIG. 4 to FIG. 6.

Figure 4A:
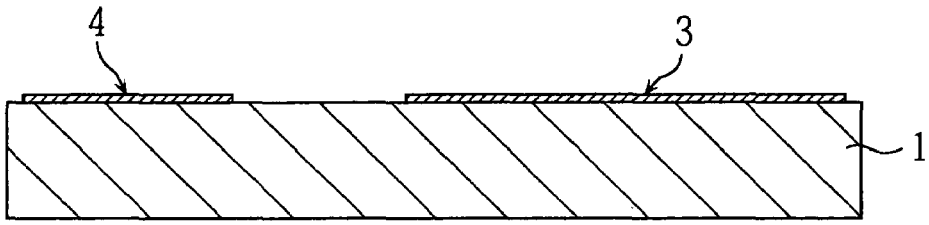
FIGS. 4*a* through 4*d* are sectional views similar to FIG. 2, showing the sequential process steps for manufacturing the variable inductor shown in FIG. 1.

Firstly, as shown in FIG. 4*a*, the input/output terminals 3, 4 are formed by patterning a Pt thin film, for example, onto an insulating substrate 1 in a prescribed shape (see FIG. 1), by means of a commonly known lithography method.

Figure 4B:
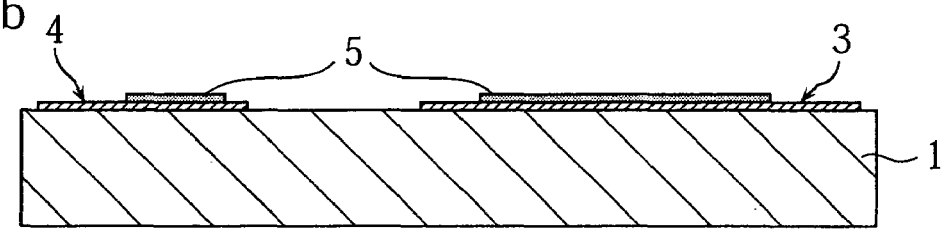

Thereupon, as illustrated in FIG. 4*b*, an insulating film 5 is formed by patterning so as to the cover the input/output terminals 3, 4, with the exception of the outer terminals 3*a*, 4*a*, 3*c*, 4*b*. For example, silicon oxide is formed over the whole face of the substrate 1 by sputtering, and the silicon oxide film thus formed is then etched into a prescribed shape.

Figure 4C:
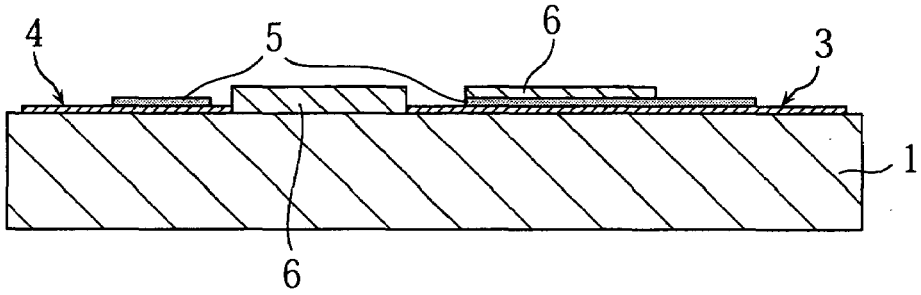

Next, as shown in FIG. 4*c*, a sacrificial layer 6 is formed by patterning onto the location where the spiral coil 2 is to be separated in a floating state from the substrate 1. More specifically, chrome (Cr), for example, being a material for the sacrificial layer 6, is formed as a film by sputtering over the whole surface of the substrate 1, and the chrome film thus formed is etched to a prescribed shape.

Figure 4D:
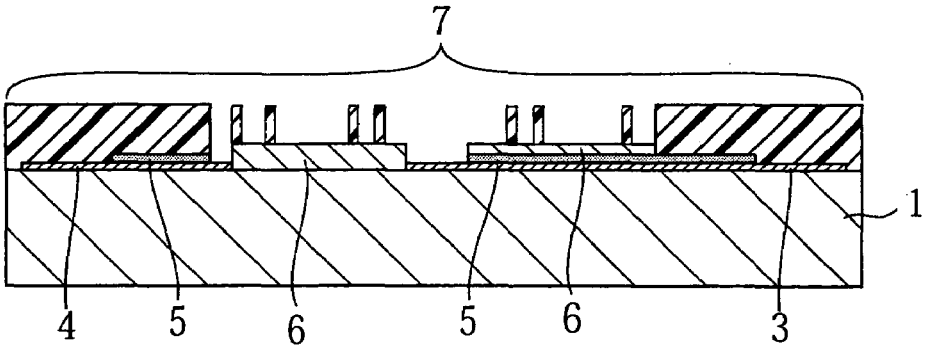

Next, as shown in FIG. 4*d*, a mask pattern 7 for forming a spiral coil 2 by lithography is formed. Concretely, a polyimide resin, for example, is formed over the whole face of the substrate 1, and this is patterned by Reactive Ion Etching (RIE), for example.

Figure 5A:
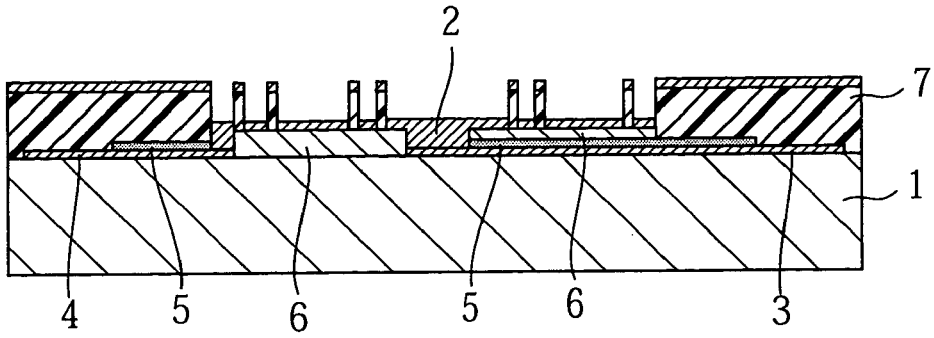
FIGS. 5*a* through 5*d* are sectional views showing the process steps for manufacturing a variable inductor, following the process steps illustrated in FIG. 4.
Figure 5B:
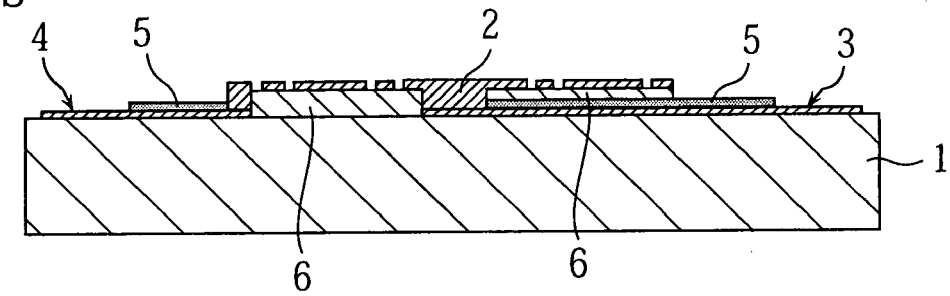
Figure 5C:
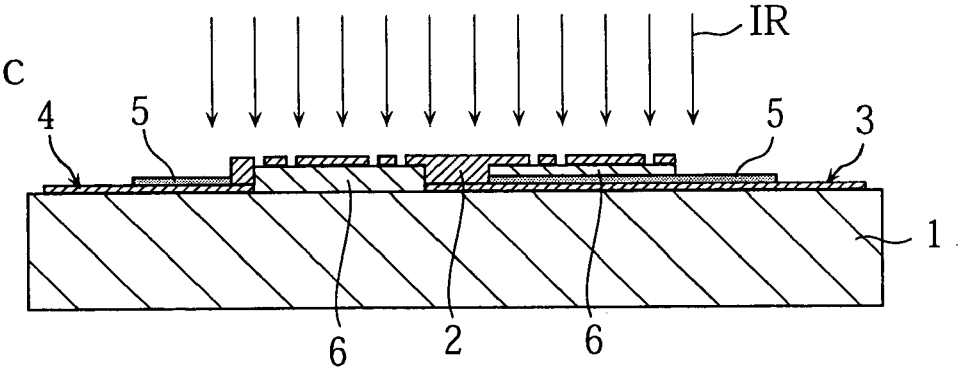
Figure 5D:
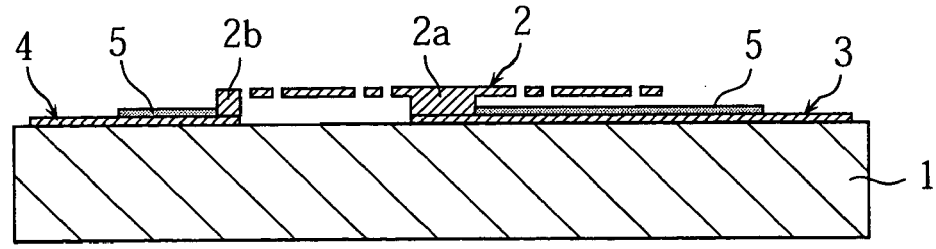

Thereupon, as shown in FIG. 5*d*, material which is to form a spiral coil 2 is vapor deposited by sputtering, via the mask pattern 7. More specifically, a film of Pd-based thin film metallic glass (Pd76Cu7Si17) is formed to a thickness of 5 μm, for example, by sputtering. As a result, the Pd-based thin film metallic glass adheres not only to the exposed regions of the input/output terminals and the sacrificial layer 5, but also to the surface of the mask pattern 7.

Thereupon, as shown in FIG. 5*b*, the mask pattern 7 is removed by means of an etching solution. Consequently, the Pd-based thin film metallic glass remaining on the surface of the mask pattern 7 is removed along with the mask pattern 7. In this case, TMAH. (Tetra Methyl Ammonium Hydroxide) or potassium hydroxide, for example, is used as the etching solution.

Next, as shown in FIG. 5*c*, a concentrated infrared beam IR is irradiated onto the formed spiral coil 2, thereby heating same. More specifically, the substrate 1 is introduced into a vacuum heating furnace evacuated to a prescribed level of vacuum (for example, 10−4 Pa) and is then heated for a prescribed period of time (for example, 30 seconds) at the temperature at which the Pd-based thin film metallic glass softens (for example, 639K). Consequently, the stress which accumulates inside the spiral coil 2 when the Pd-based thin film metallic glass is formed by sputtering is alleviated by the annealing action generated by the heating and softening process. Incidentally, the heating process may also be performed by irradiating laser light, instead of irradiating an infrared beam IR.

Next, as shown in FIG. 5*d*, the sacrificial layer 6 made from chrome is eliminated by means of an etching solution. Consequently, the portion of the spiral coil 2 apart from the inner terminal 2*a* and the outer terminal 2*b* floats above and is isolated from the substrate 1. In this case, a mixed etching solution of cerium diammonium nitrate and perchloric acid is used, for example. The structure shown in FIG. 5*d* is exactly the same as that in FIG. 2.

Figure 6A:
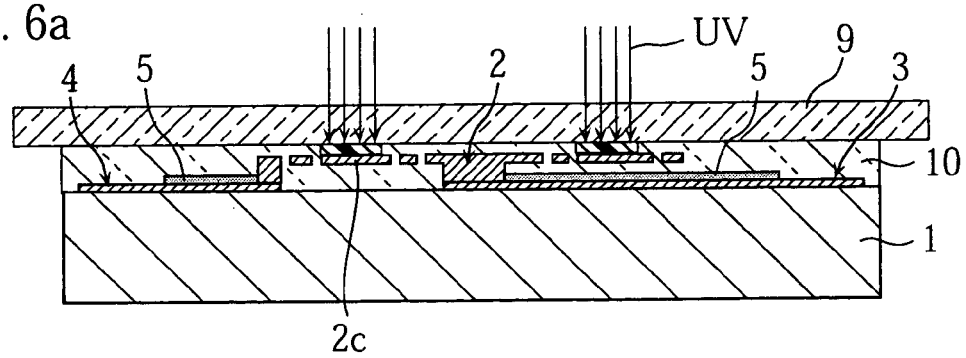
FIGS. 6*a* through 6*d* are sectional views showing a process for adjusting inductance in the variable inductor according to the first embodiment.

In the variable inductor fabricated in this fashion, the inductance is adjusted by the following method. Specifically, as shown in FIG. 6*a*, a photosensitive polyimide resin 10, for example, is filled in between a glass plate 9 and the substrate 1 (the spiral coil 2 side thereof), and an ultraviolet beam UV is irradiated selectively onto a ring-shaped central portion 2*c* of the spiral coil 2, from the glass plate 9 side. Consequently, only the portion of the filled photosensitive polyimide resin 10 which corresponds to the ring-shaped centre portion 2*c* of the spiral coil 2 is hardened.

Figure 6B:
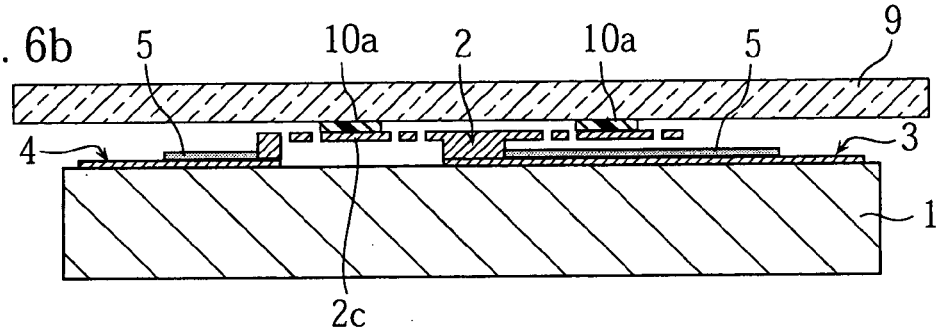

Thereupon, as shown in FIG. 6*b*, the unhardened portion of the photosensitive polyimide resin 10 is removed by means of an etching solution. Consequently, the hardened portion of the photosensitive polyimide resin 10 remains as a bonding layer 10*a* and a state is assumed where the glass plate 9 is bonded to the ring-shaped centre portion 2*c* of the spiral coil 2. TMAH, for example, is used as the etching solution for removing the unhardened photosensitive polyimide resin 10.

Figure 6C:
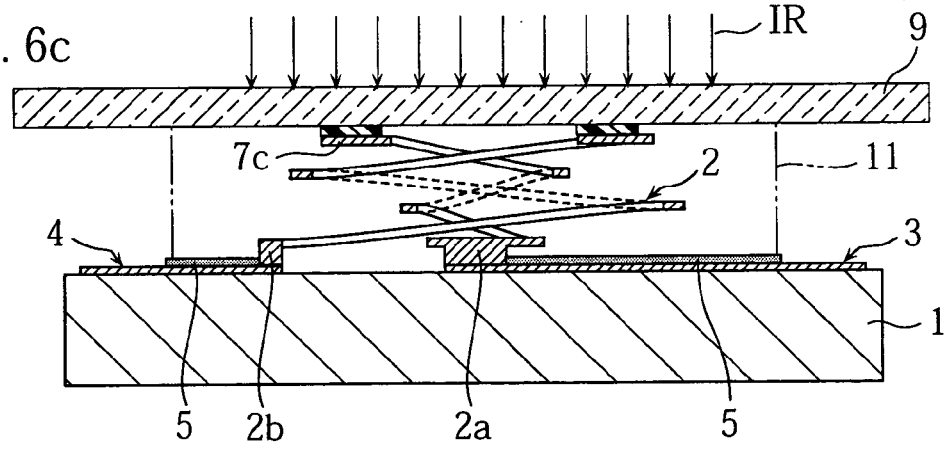

Next, as shown in FIG. 6*c*, the glass plate 9 is moved upwards, thereby extending the spiral coil 2 and causing it to deform elastically into a circular conical shape. The height of the coil 2 can be set readily by means of adjusting the height to which it is raised by the glass plate 9, by means of a jig (not illustrated), or the like. Furthermore, the height of the coil 2 which can be fabricated is dependent on the number of windings and the material used, but the Pd-based thin film metallic glass used in the present embodiment has excellent elasticity and can generally be extended to approximately half the external diameter of the coil. In the present embodiment, since the coil 2 is formed in an approximately circular spiral shape, it forms a circular conical shape when subjected to elastic deformation, but if a coil formed in a square spiral shape were to be deformed elastically, then it would form a square conical shape. In the present invention, the concrete shape is not important, provided that the element is able to function as a coil.

Next, as also shown in FIG. 6*c*, the elastically deformed spiral coil 2 is heated by irradiating a concentrated infrared beam IR thereon. More specifically, the substrate 1 is introduced into a vacuum heating furnace evacuated to a prescribed vacuum level (for example, 10−4 Pa), and is then heated by infrared irradiation to a temperature at which the Pd-based thin film metallic glass softens (for example, 639K), for a prescribed time period (for example, 30 seconds). Consequently, the stress generated inside the spiral coil 2 due to the elastic deformation is eased by the annealing action of the heating and softening process. Incidentally, heating may be performed by irradiating laser light, instead of irradiating infrared IR energy.

Figure 6D:
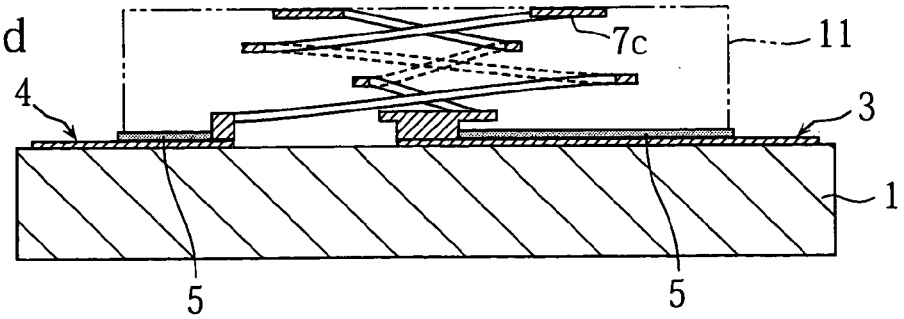

Finally, as shown in FIG. 6*d*, the remaining adhesive layer 10*a* is dissolved by means of an etching solution and the glass plate is removed 9. Consequently, a variable inductor as illustrated in FIG. 3 (in which the inductance has been adjusted) is obtained. The diameter of the spiral coil 2 in the variable inductor actually fabricated in accordance with the present embodiment was 855 μm.

Figure 7:
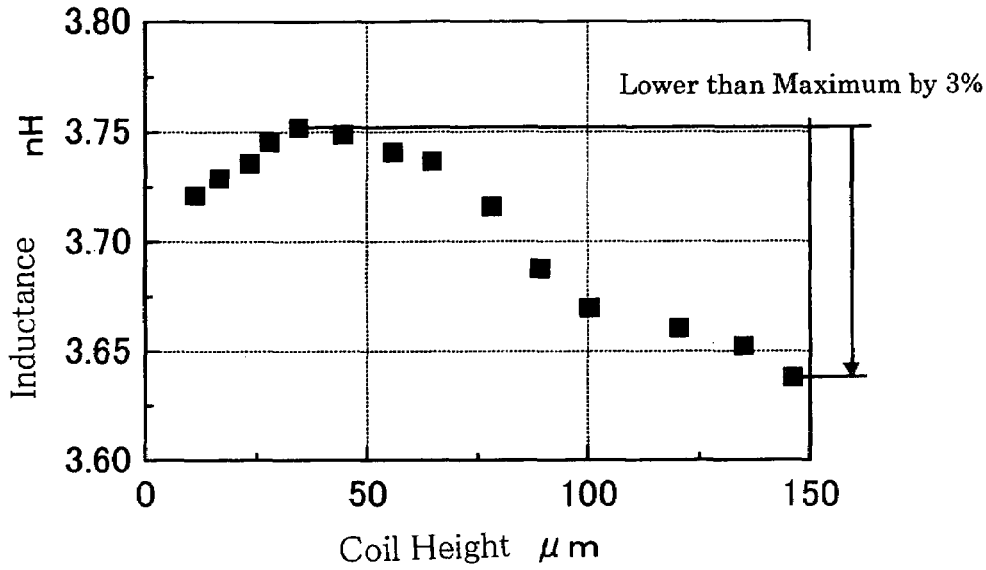
FIG. 7 is a graph showing the relationship between inductance and coil height in the first embodiment.

FIG. 7 is a graph showing the variation of inductance with change in the height of the variable inductor fabricated as shown above. As the graph reveals, it is possible to alter the inductance by approximately 3% of the maximum value, by changing the height of the spiral coil 2 from 50 μm to 150 μm.

In the stages illustrated in FIGS. 6*c* and 6*d*, if the inductance of the variable inductor is already equal to the target value, then resin which does not affix to the glass plate 9 (for example, epoxy or polyurethane resin) should be filled in between the substrate 1 and the glass plate 9, whilst avoiding the outer terminals 3*a*, 4*a* of the terminals 3, 4, in such a manner that the inductance of the inductor will not change (see dotted line 11 in FIGS. 6*c* and 6*d*). After the resin 11 has hardened (or solidified), the glass plate 9 is removed.

Figure 8:
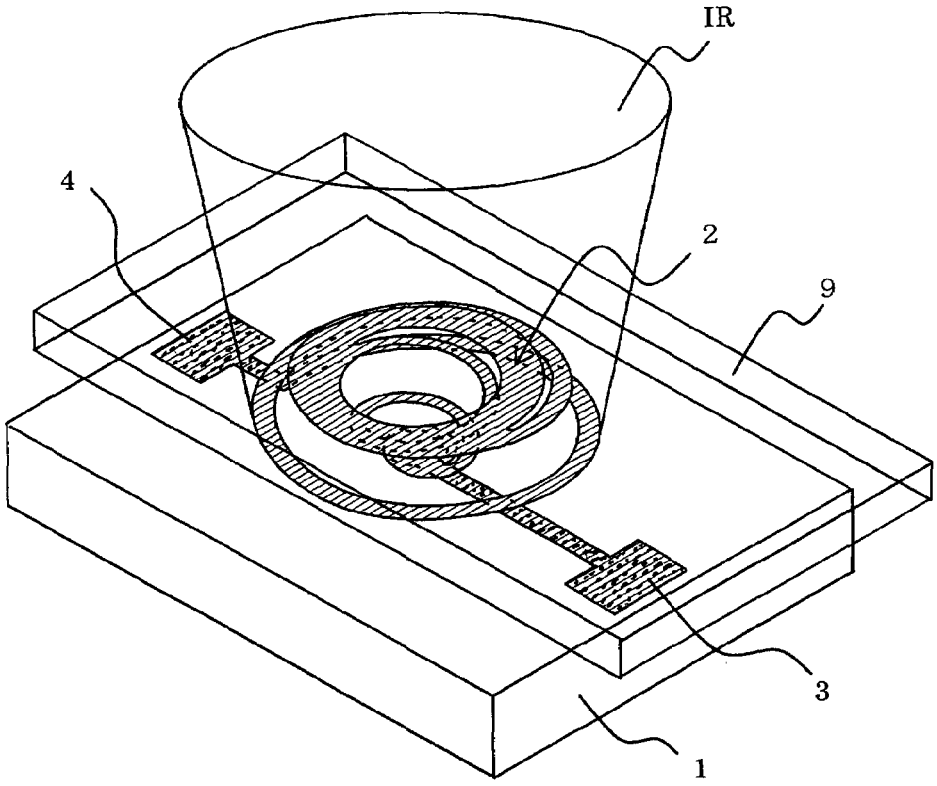
FIG. 8 is a perspective view showing a method for readjusting inductance according to the first embodiment.

On the other hand, if readjusting the inductance after it has already been adjusted, as illustrated in FIG. 8, the spiral coil 2 in the variable inductor is elastically deformed by pressed it via the glass plate 9. In this state, a concentrated infrared beam IR is irradiated onto the spiral coil 2 in a vacuum or inert gas atmosphere (for example, a noble gas or nitrogen gas), thereby heating the coil 2 to a temperature (for example, 639K) at which the Pd-based thin film metallic glass softens, for a prescribed period of time (for example, 30 seconds). Consequently, it is possible to readjust the inductance of the variable inductor by means of elastic deformation of the spiral coil 2, as well as easing the stress generated inside the spiral coil 2 due to the elastic deformation, by means of the annealing action of the heating and softening process. After readjustment of the inductance, the area surrounding the variable inductor is filled with a resin which will not adhere to the glass plate 9, and once this resin has hardened, the glass plate 9 is removed and the readjusted spiral coil 2 is fixed.

Second Embodiment

Figure 9:
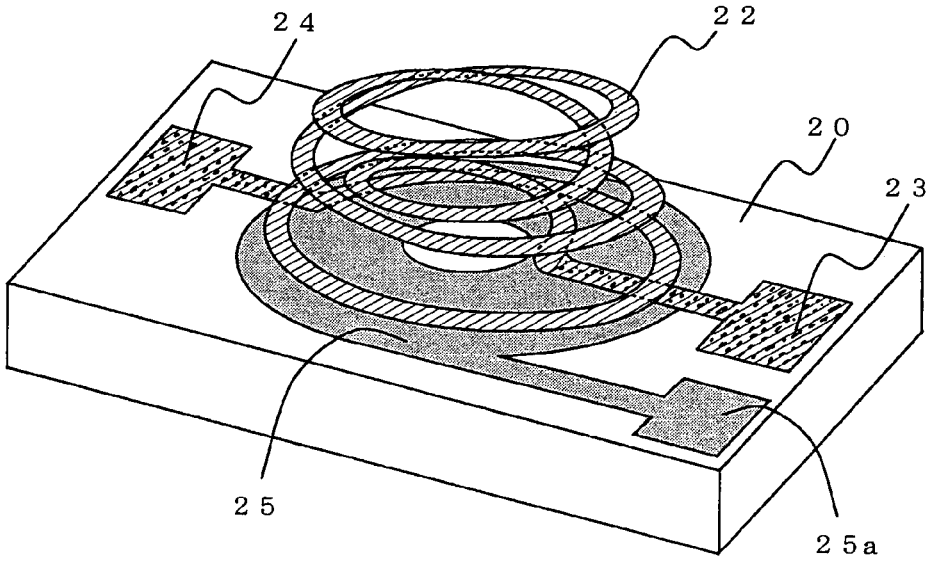
FIG. 9 is a schematic perspective view showing a variable inductor according to a second embodiment.

FIG. 9 is a schematic perspective view showing a variable inductor according to a second embodiment of the present invention.

The variable inductor according to the present embodiment takes a wafer of 300 μm thickness, for example, having a 1 μm thick thermal oxide film (not illustrated) formed on the surface of a monocrystalline silicon surface having a 100 crystal orientation, as a substrate 21, and after forming a mask pattern for lithography thereon, a film of Pt is formed by sputtering to a thickness of 2 μm, whereupon the mask pattern is removed, thereby forming an approximately doughnut-shaped driving electrode 25. The driving electrode is connected to a connection terminal 25*a*.

A film of silicon oxide of 1 m thickness, for example, is formed as an insulating layer (not illustrated) by means of CVD on the region of the driving electrode 25 apart from the connection terminal 25*a*. A spiral coil 22 and input/output terminals 23, 24 made from Pd-based thin film metallic glass are formed on the surface of the insulating layer or substrate 21, by means of a process similar to that of the first embodiment (see FIGS. 4 and 5). Moreover, the inductance is adjusted by lifting the coil 22 upwards in a circular conical fashion, by means of a similar process to that of the first embodiment (see FIG. 6).

When a higher voltage than the signal voltage of the coil 22 is applied to the drive electrode 25, the coil 22 is attracted towards the substrate 21, thereby altering the height thereof and changing the inductance. Moreover, since the amount of height change can be adjusted according to the voltage applied to the drive electrode 25, then it is possible to adjust the inductance in a dynamic and continuous fashion. The initial inductance (inductance in a state where no attracting force is applied to the coil) which forms a reference for dynamic variation can be set appropriately and, furthermore, can be readjusted, in the manner described in the first embodiment.

Third Embodiment

Figure 10:
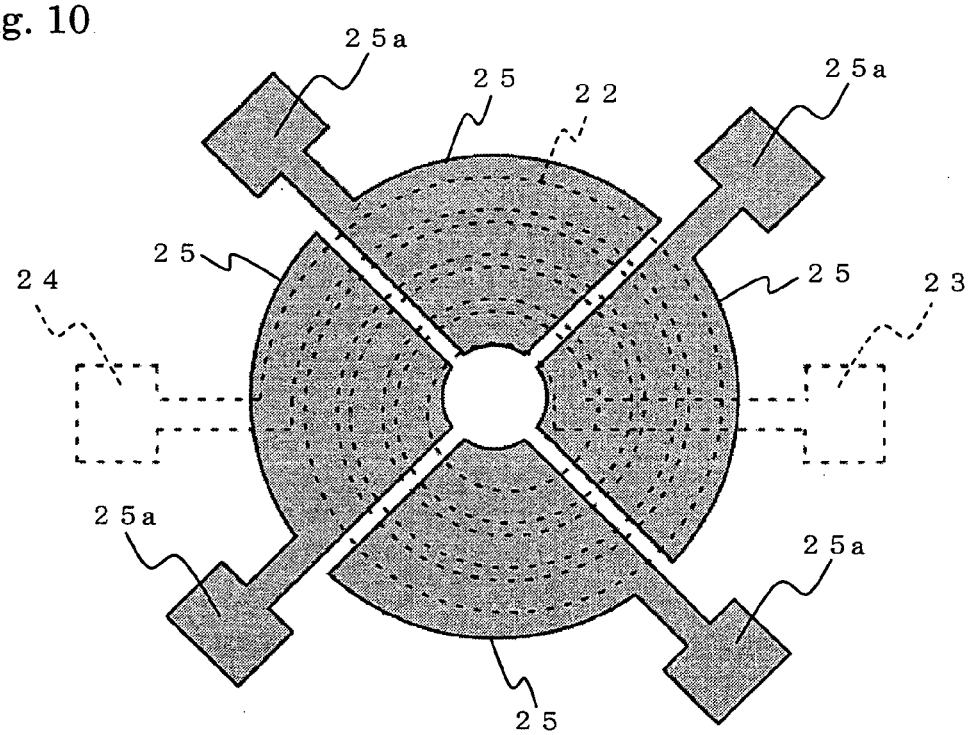
FIG. 10 is a schematic plan view showing a principal part of a variable inductor according to a third embodiment.

FIG. 10 is a schematic plan view showing the principal parts of a variable inductor according to a third embodiment of the present invention. In this figure, elements which are the same as or similar to those illustrated in FIG. 9 are labelled with the same reference symbols. Furthermore, in FIG. 10, the spiral coil 22 and input/output terminals 23, 24 are indicated by dotted lines. This situation also applies in FIGS. 11 and 12 described hereinafter.

The basic structure of the variable inductor according to the present embodiment is the same as that of the variable inductor (FIG. 9) according to the second embodiment, it being differentiated from the second embodiment in that it comprises a plurality of divided drive electrodes 25, which are connected respectively to the connection terminal 25*a*.

In the variable inductor according to the second embodiment shown in FIG. 9, since a virtually uniform electric potential is applied across the whole drive electrode 25, it is not possible for there to be any variation in the static attracting force, depending on the position. In a structure of this kind, it was found that the height of the spiral coil 22 declines continuously as the electric potential applied to the drive electrode 25 is increased, up to a prescribed attraction threshold value (for example, 160V), but if it exceeds this threshold value, then the whole of the spiral coil 22 is suddenly attracted completely to the drive electrode 25 side, this state of complete attraction being maintained until the voltage is subsequently reduced to a prescribed release threshold value (for example, 70V). Consequently, this is disadvantageous if the dynamic range of adjustment of the inductance is to be made large.

In the present embodiment, as shown in FIG. 10, by appropriately selecting a plurality of divided drive electrodes 25 and applying voltage to same, it is possible to cause the height (inductance) of the spiral coil 22 to vary in a step like fashion. For example, one or two or three drive electrodes 25 can be selected in a variety of combinations and voltage applied thereto. By this means, it becomes improbable that the spiral coil 22 will become completely attracted to the drive electrode 25 side, and hence a large range of dynamic adjustment can be set for the inductance.

Fourth Embodiment

Figure 11:
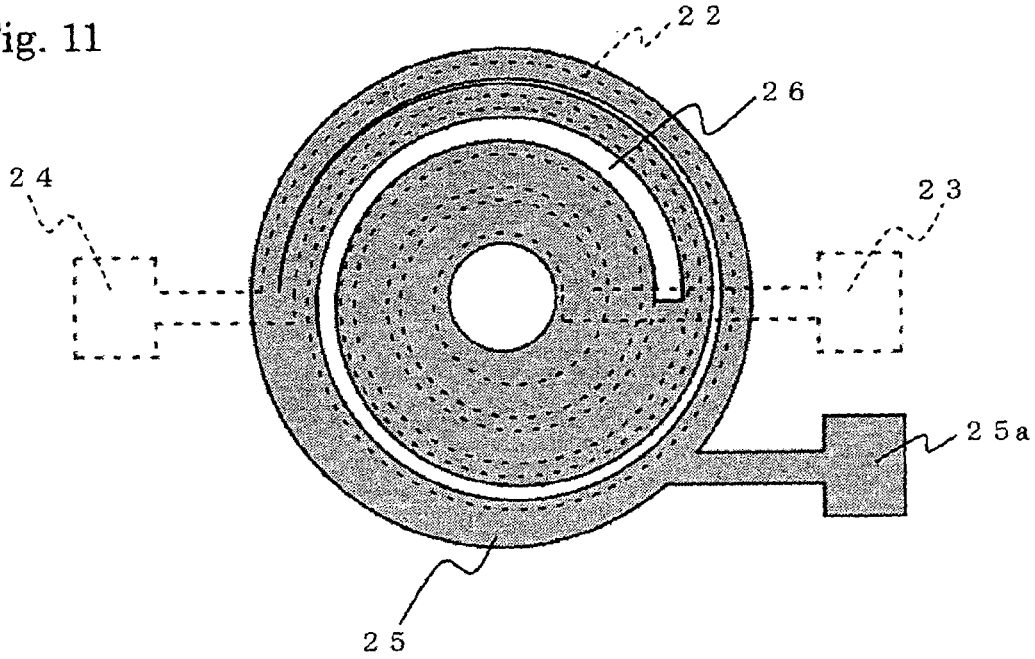
FIG. 11 is a schematic plan view showing a principal part of a variable inductor according to a fourth embodiment.

FIG. 11 is a schematic plan view showing the principal part of a variable inductor according to a fourth embodiment of the present invention.

The variable inductor according to the present embodiment has the same basic structure as the variable inductor (FIG. 9) according to the second embodiment, being differentiated from the second embodiment in that it comprises a spiral slit 27 wherein the width of the drive electrode 25 gradually becomes narrower. By adopting a structure of this kind, the electrostatic force generated between the drive electrode 25 and the spiral coil 22 is caused to vary depending on the position, and therefore it becomes improbable that the whole of the coil 22 will be attracted completely to the drive electrode 25 side. Accordingly, it becomes possible to set a large range of dynamic and continuous adjustment of the inductance.

Fifth Embodiment

Figure 12:
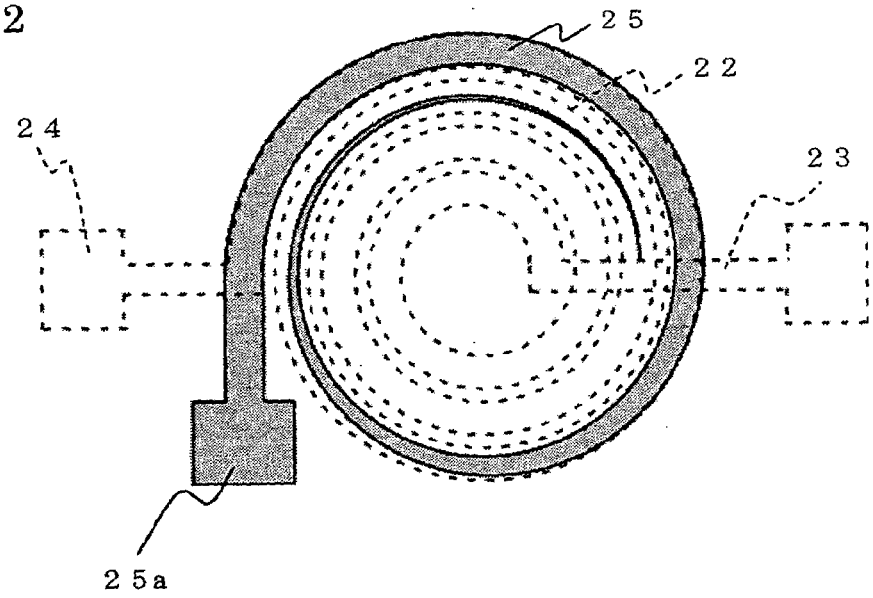
FIG. 12 is a schematic plan view showing a principal part of a variable inductor according to a fifth embodiment.

FIG. 12 is a schematic plan view showing the principal part of a variable-inductor according to a fifth embodiment of the present invention.

The variable inductor according to the present embodiment also has the same basic structure as that of the variable inductor according to the second embodiment (FIG. 9), being differentiated from the second embodiment in that the width of the actual drive electrode 25 gradually becomes narrower. By means of a structure of this kind, the electrostatic force generated between the drive electrode 25 and the spiral coil 22 varies depending on the position, and hence it becomes improbable that the whole of the coil 22 will be attracted completely to the drive electrode 25 side. Consequently, it becomes possible to set a large range of dynamic and continuous adjustment of the inductance.

Sixth Embodiment

Figure 13:
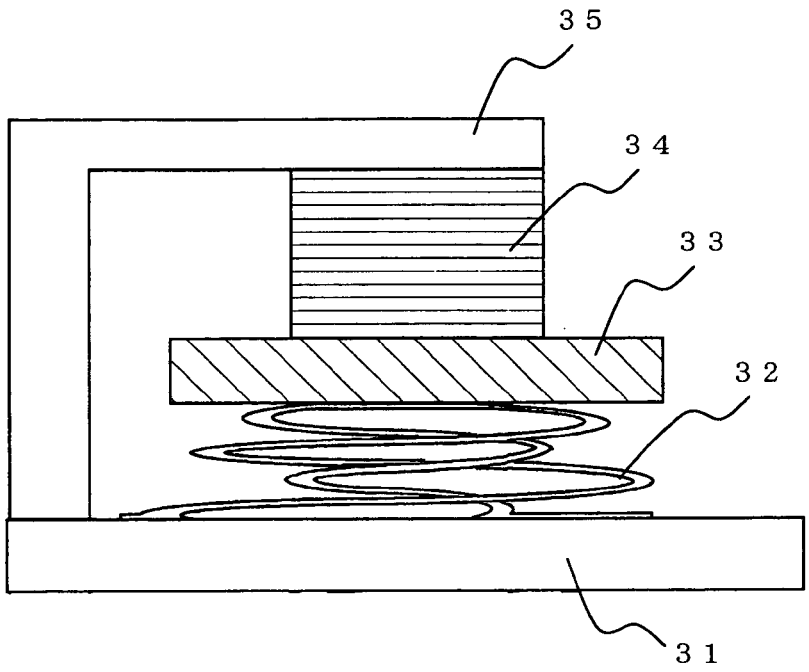
FIG. 13 is a schematic front view showing a principal part of a variable inductor according to a sixth embodiment.
Figure 14:
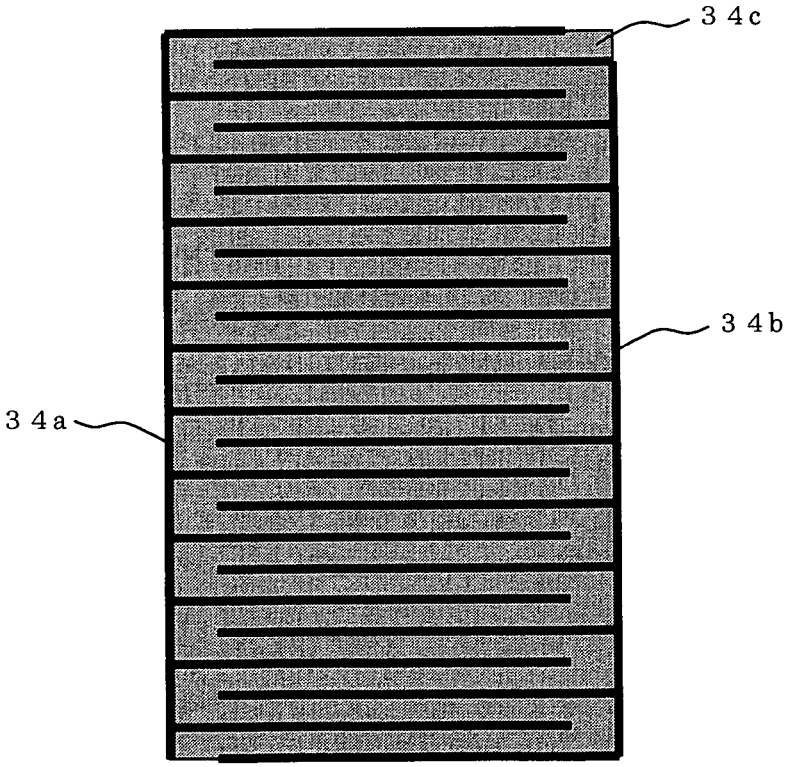
FIG. 14 is a view showing a structural example of a piezoelectric actuator used in the variable inductor according to the sixth embodiment.

FIG. 13 and FIG. 14 show a variable inductor according to a sixth embodiment of the present invention.

In the present embodiment, a spiral coil 32 is fabricated by a similar process to that of the first embodiment on a quartz substrate 31 of 150 μm thickness, for example, together with input/output terminals which are electrically connected thereto (these do not appear in FIG. 13). An insulating pressing member 33 is abutted against the upper face of this coil 32, and this pressing member 33 is installed on top of the substrate 31 by means of a piezoelectric actuator 34 and a supporting member 35. The pressing member 33 is made of polytetrafluoroethylene, for example, which has a dielectric constant close to 1.

The piezoelectric actuator 34 has a structure as illustrated in FIG. 14, for example. More specifically, the piezoelectric actuator 34 has a structure wherein a piezoelectric body 34*c* is interposed between a comb-shaped first electrode 34*a* and a similarly comb-shaped second electrode 34*b*. In the present embodiment, the first electrode 34*a* is affixed to the supporting member 35 and the second electrode 34*b* is affixed to the pressing member 33. The interval between the comb teeth of the respective electrodes 34*a*, 34*b* is, for example, 25–100 μm, and the number of layers of the piezoelectric body 34*c* is, for example, 100 layers.

In the variable inductor of the structure described above, the piezoelectric body 34*c* deforms when a voltage is applied between the electrodes 34*a*, 34*b* of the piezoelectric actuator 34, thereby causing the coil 32 to be pressed towards the substrate 31, via the pressing member 33. Consequently, the inductance is changed by the variation in the height of the coil 32.

There is no problem regarding insulation between the piezoelectric actuator 34 and the coil 32, and provided that the dielectric constant of the piezoelectric actuator 34 does not have any adverse effect on the change in the inductance of the coil 32, then it is possible to omit the pressing member 33. Moreover, it is also possible to use a commonly known electrostatic actuator instead of the piezoelectric actuator 34. Furthermore, the height of the coil 32 can also be adjusted manually, by pressing the coil 32 by means of a feed screw mechanism, instead of an actuator of this kind.

Seventh Embodiment

Figure 15:
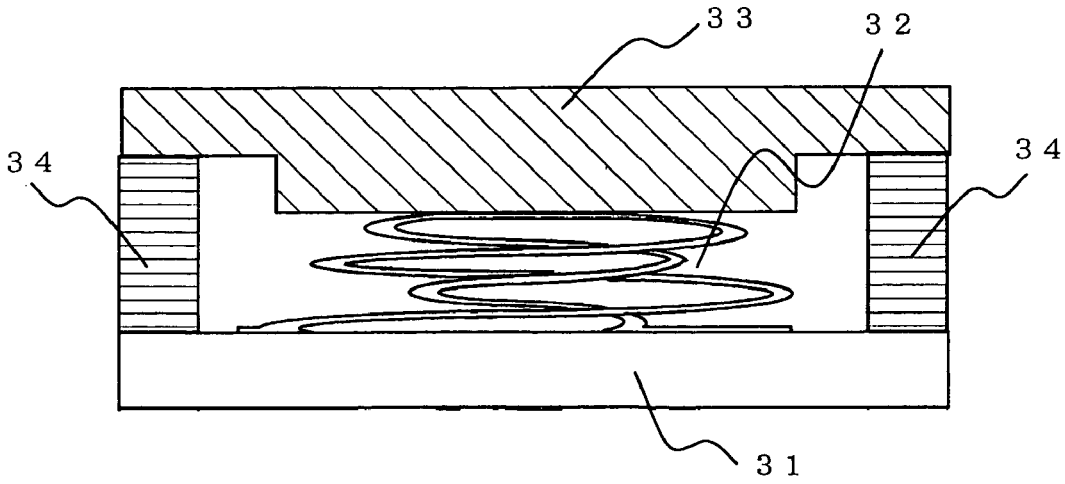
FIG. 15 is a schematic front view showing a principal part of a variable inductor according to the seventh embodiment.

FIG. 15 shows a variable inductor according to a seventh embodiment of the present invention. In this figure, elements which are the same or similar to those illustrated in FIGS. 13 and 14 are labelled with the same reference symbols.

In terms of operational principles, the variable inductor according to the present embodiment is the same as that according to the sixth embodiment, but it differs in that a plurality of piezoelectric actuators 34 are interposed between the substrate 31 and the pressing member 33. Moreover, the structure of the respective piezoelectric actuators 34 is as illustrated in FIG. 14. However, in the seventh embodiment, the polarity of the applied voltage is the inverse of that in the sixth embodiment, and the piezoelectric actuator 34 is driven so as to contract.

Eighth Embodiment

Figure 16:
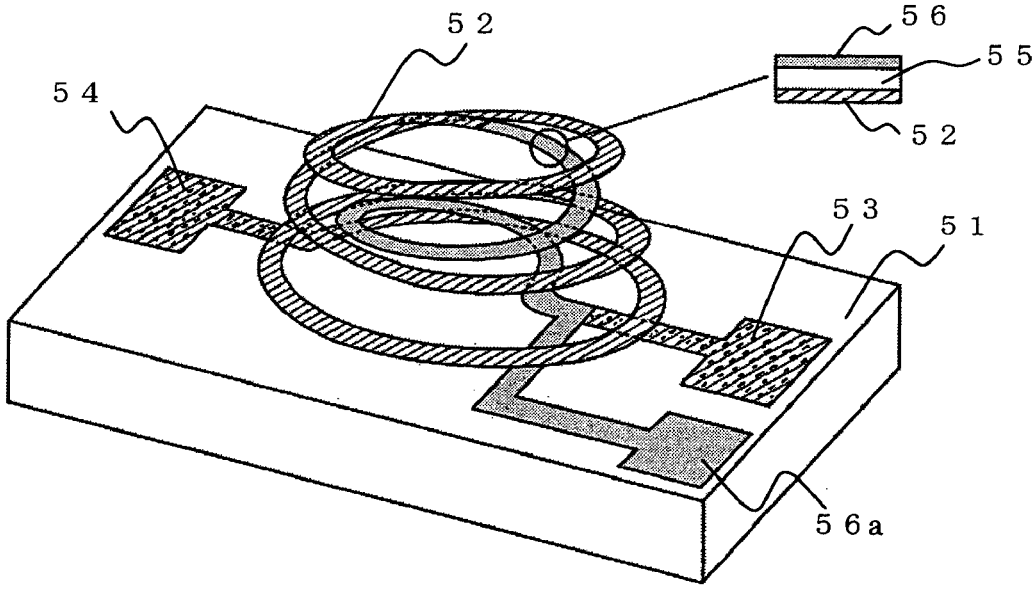
FIG. 16 is a schematic perspective view showing a variable inductor according to an eighth embodiment.

FIG. 16 is a perspective view showing a schematic view of the a variable inductor according to an eighth embodiment of the present invention.

As shown in FIG. 16, similarly to the second embodiment, a wafer of 300 μm thickness, for example, and having a 1 μm thick thermal oxide film (not illustrated) formed on the surface of monocrystalline silicon having a 100 crystal orientation, is taken as a substrate 51, and a spiral coil 52 and input/output terminals 53, 54 made from Pd-based thin film metallic glass are formed thereon by a process similar to that of the first embodiment. Furthermore, before the coil 52 is raised up so as to form a circular conical shape, a piezoelectric thin film (PZT) 55 and a supplementary electrode (Pt) 56 are patterned and layered by means of commonly known sputtering and etching techniques, on the portion of the coil 52 that is to be uppermost from the inner end of the coil 52. A driving terminal 56*a* is connected to the subsidiary electrode 56.

In the present embodiment, by applying a voltage higher than the signal voltage of the coil 52 to the supplementary electrode 56 from the drive terminal 56*a*, the piezoelectric thin film 55 sandwiched between the coil 52 and the supplementary electrode 56 will be compressed by a lateral piezoelectric effect, the portion where there the piezoelectric thin film 55 is present will be displaced in a direction whereby it is lifted up from the substrate 51, and hence the height of the coil 52 will change. Consequently, the inductance of the coil 52 will change dynamically.

In the present embodiment, the piezoelectric thin film 55 is formed in a region extending from the inner end of the coil 52 to the highest point thereof, but it is also possible to form it in a region extending from the outer circumference of the coil 52 to the highest point thereof, or to form it over the whole surface of the coil 52.

Ninth Embodiment

Figure 17A:
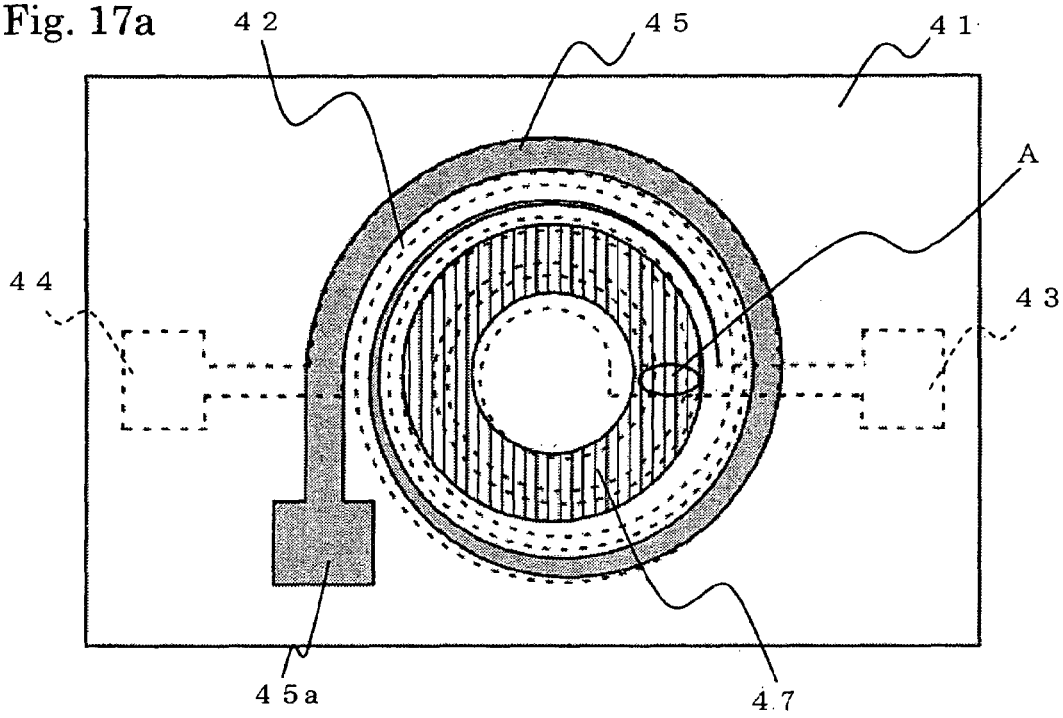
FIGS. 17*a* and 17*b* are views showing a variable inductor according to a ninth embodiment.
Figure 17B:
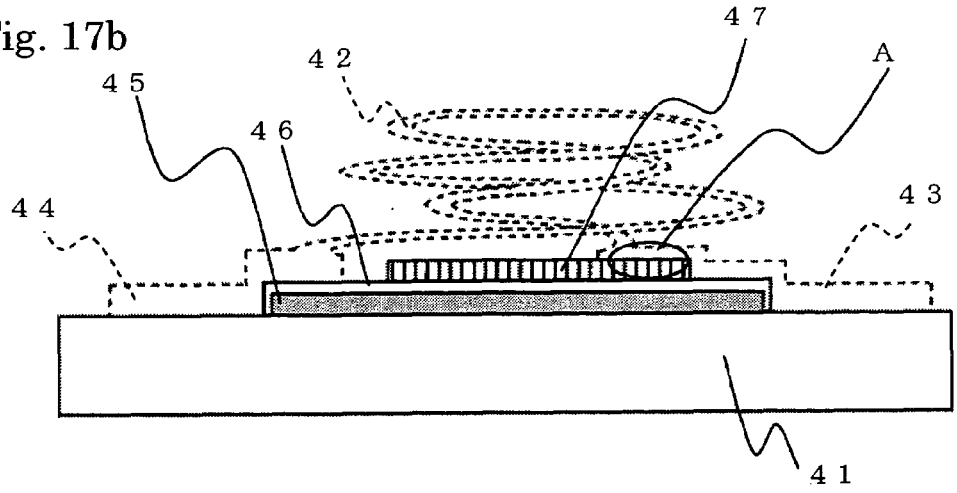

FIGS. 17*a* and 17*b* gives an illustrative view of a variable inductor according to a ninth embodiment of the present invention. FIG. 17*a* is a plan view of this variable inductor, whereas FIG. 17*b* is a side view of the variable inductor.

As shown in FIGS. 17*a* and 17*b*, similarly to the second embodiment, a wafer of 300 μm thickness, for example, having a 1 μm thick thermal oxide film (not illustrated) on the surface of monocrystalline silicon having 100 crystal orientation, is taken as the substrate 41, and a mask pattern is formed thereon using lithography, whereupon a film of Pt is formed to a thickness of 2 μm by sputtering and the mask pattern is removed, thereby forming a fine-tipped coil-shaped driving electrode 45 which is connected to the connection terminal 45*a*. A 1 μm thick silicon oxide film, for example, is formed as an insulating layer 46 by means of CVD on the portion of the driving electrode 45 apart from the connection terminal 45*a*. A doughnut-shaped connecting plate 47 is formed on top of this insulating layer 46 by Pt. Thereupon, a spiral coil 42 and input/output terminals 43, 44 made from Pd-based thin film metallic glass are formed by a process similar to that of the first embodiment, and adjustment is performed in such a manner that a prescribed initial inductance is obtained. Moreover, the connection plate 45 and coil 42 are electrically connected to portion A illustrated in FIG. 17. In this figure, the spiral coil 42 and the input/output terminals 43, 44 are depicted by dotted lines.

In the present embodiment, if a voltage higher than the signal voltage of the coil 42 is applied to the drive electrode 45, then an electrostatic force with act between the coil 42 and the drive electrode 45, the coil 42 will be attracted towards the substrate 41, and the height of the coil 42 will change elastically. Since the drive electrode 41 has a coil shape which diminishes in size towards the tip thereof, the electrical field intensity is not uniform, and hence the height varies approximately in direct proportion to the voltage applied, rather than the coil 42 being attracted at once. As the external circumference of the coil 42 is attracted towards the substrate 41 the coil 42 progressively approaches the substrate 41, starting from the central portion of the coil 42, and makes contact with the connection plate 47. Since the connection plate 45 is electrically connected to the coil 42 in portion A, the number of windings of the coil 42 is substantially reduced in accordance with the length of this contact, and the inductance can be varied to a greater extent in accordance with change in the height of the coil 42, that in the embodiments described previously. Since the external circumference of the coil 42 is situated to the outer side of the connection plate 47 and does not oppose the connection plate 47, then even when it is attracted to the substrate 41 side, it will not contact with the connection plate 47.

In the present embodiment, the shape of the drive electrode 45 is a fine-tipped spiral shape, similarly to that of the fifth embodiment (FIG. 12), but it may also be of a similar shape to that of the third embodiment (FIG. 10) or the fourth embodiment (FIG. 11). Moreover, it is not essential to use the electrostatic force by means of a drive electrode 45, and it is also possible to adopt a connection plate 47 for a drive system using a piezoelectric actuator 34, or a piezoelectric thin film 55, as in the sixth embodiment (FIGS. 13 and 14), or seventh embodiment (FIG. 15), or eighth embodiment (FIG. 16). Furthermore, according to the present embodiment, the inductance is changed by means of the coil 42 being deformed (attracted or pushed) in the direction of the substrate 41, thereby contacting the connection plate 47 and reducing the essential number of windings of the coil 42, but conversely, it is also possible to cause the coil 42 to contact the connection plate 47 in the initial state, and then to change the inductance by deforming (extending) the coil in the direction away from the substrate 41, thereby separating it from the connection plate 47 and hence increasing the essential number of windings.

Tenth Embodiment

Figure 18:
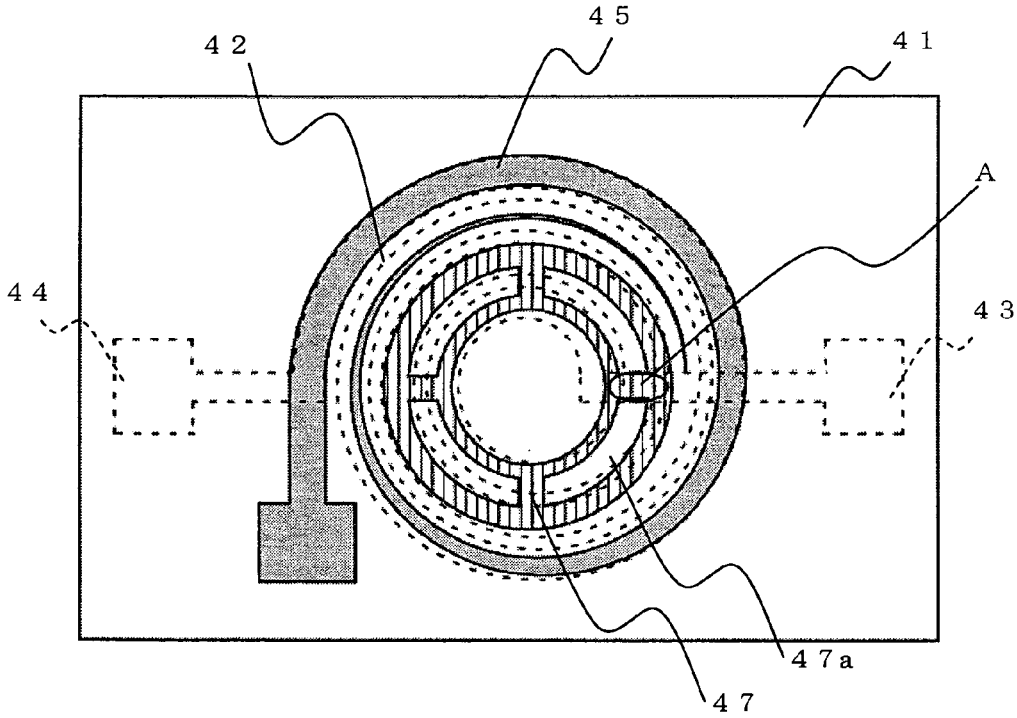
FIG. 18 is a schematic plan view showing a variable inductor according to a tenth embodiment.

FIG. 18 is an illustrative view of a variable inductor according to a tenth embodiment of the present invention. In this figure, any elements which are the same as or similar to those illustrated in FIG. 17 are labelled with the same reference symbols.

The variable inductor of the present embodiment is similar to the variable inductor of the ninth embodiment in terms of the basic structure thereof, but it differs in that a plurality of slits 47*a* arranged at intervals in the circumferential direction are provided on the connection plate 47. By adopting this structure, it becomes easier for the magnetic flux to pass through the coil 42 and hence losses are reduced.

As described above, according to the present invention, it is possible to provide a small-scale variable inductor suitable for application to a mobile communications device, or the like, wherein the inductance can be changed in a semi-permanent fashion or a dynamic fashion.

The invention claimed is:

1. A variable inductor comprising: a substrate; a thermally softenable spiral coil provided on said substrate and including two ends fixed to said substrate; and a pair of input/output terminals electrically connected to said ends of said coil, respectively;

wherein said coil is made from a non-crystalline thin film metallic glass which softens in a supercooled liquid phase; and wherein a portion of said coil other than said two ends is separated from said substrate for floating.

2. The variable inductor according to claim 1, wherein said coil is formed from at least one material selected from a group consisting of an electrically conductive material, a non-conductive material formed with a coating of electrically conductive material, and an electrically conductive material formed with a coating of another electrically conductive material.

3. The variable inductor according to claim 1, wherein a piezoelectric thin film and a driving electrode are formed over said coil, and a connection terminal connected to said drive electrode is provided on said insulating substrate.

4. The variable inductor according to claim 1, further comprising a pressing member abutting against said coil, and an actuator or adjustment mechanism for driving the pressing member heightwise of said coil.

5. The variable inductor according to claim 4, wherein said actuator supports said pressing member from an opposite side to said coil.

6. The variable inductor according to claim 4, wherein said actuator supports said pressing member from a same side as said coil.

7. The variable inductor according to claim 1, wherein a drive electrode is further provided on said substrate underneath said coil, via an insulating layer, in such a manner that a height of said coil can be changed electrostatically by applying a voltage between the drive electrode and said coil.

8. The variable inductor according to claim 7, wherein a plurality of said drive electrodes are provided opposing said coil, and connection terminals are provided for applying voltage individually to each of the drive electrodes.

9. The variable inductor according to claim 7, wherein said drive electrode comprises a spiral slit extending circumferentially of said coil.

10. The variable inductor according to claim 7, wherein said drive electrode is spiral and has a width which varies as the electrode extends circumferentially of said coil.

11. The variable inductor according to claim 7, further comprising a connection plate connected to one end of said coil, for contacting a portion of said coil other than said end, thereby reducing the effective number of windings of said coil, when the coil has been deformed elastically in a height reducing direction, and for conversely increasing the effective number of windings of said coil when said coil has been deformed elastically in a height increasing direction.

12. The variable inductor according to claim 11, wherein said connection plate has a doughnut shape.

13. The variable inductor according to claim 12, wherein said connection plate is provided with a plurality of slits arranged at circumferential intervals.

14. A method for adjusting the inductance of a variable inductor comprising an insulating substrate, a thermally softenable spiral coil provided on said insulating substrate and including two ends fixed to said substrate, and a pair of input/output terminals electrically connected to said ends of said coil, respectively, a portion of said coil other than said two ends being separated from said substrate for floating, said method comprising, at the least, the steps of:

compressing or extending said floating portion of said coil, thereby changing a height thereof; and heating said coil to a softening temperature thereof after the change of the height followed by cooling to set an initial height of said coil.

15. The method for adjusting inductance according to claim 14, further comprising the step of fixing the initial height set for said coil by enclosing said coil in resin.

16. The method for adjusting inductance according to claim 14, further comprising the step of dynamically changing the height of said coil by compressing or extending said coil electrostatically or piezoelectrically after the setting of the initial height.

17. The method for adjusting inductance according to claim 14, wherein said coil is made from a non-crystalline thin film metallic glass which softens in a supercooled liquid phase.

* * * * *